United States Patent [19]

Nesses

[11] 4,272,739

[45] Jun. 9, 1981

[54] HIGH-PRECISION ELECTRICAL SIGNAL ATTENUATOR STRUCTURES

[76] Inventor: Morton Nesses, 715 Carmen Plz., Greenwood, Ind. 46142

[21] Appl. No.: 85,967

[22] Filed: Oct. 18, 1979

[51] Int. Cl.[3] ..... H01P 1/22

[52] U.S. Cl. ..... 333/81 A; 338/325

[58] Field of Search ..... 333/81 R, 81 A, 22 R; 338/216, 308, 309, 325

[56] References Cited

U.S. PATENT DOCUMENTS

| | | | |
|---|---|---|---|
| 2,407,251 | 9/1946 | Christensen | 338/325 |
| 3,227,975 | 1/1966 | Hewlett et al. | 333/81 A |
| 3,260,971 | 7/1966 | Bacher et al. | 333/81 A |
| 3,582,842 | 6/1971 | Friedman | 333/81 A |
| 3,824,506 | 7/1974 | Bacher | 338/309 X |
| 4,011,531 | 3/1977 | Gaudet | 333/81 A |

*Primary Examiner*—Paul L. Gensler

*Attorney, Agent, or Firm*—Jenkins, Coffey, Hyland, Badger & Conard

[57] ABSTRACT

A high-precision signal attenuator for insertion into a coaxial line, or the like, includes a dielectric substrate upon which are provided, by vacuum deposition, painting, or the like, an input electrode, an output electrode, and two shunt electrodes. The input and output electrodes are positioned on the substrate for coupling to the center conductor of the line and the shunt electrodes are positioned along opposite edges of the substrate for coupling to the outer conductor of the line. The outer conductor is illustratively maintained at ground while the center conductor carries the signal to be attenuated. A distributed resistive film element is positioned on the substrate surface among the four electrodes. The distributed film element comprises a center portion, which is illustratively rectangular or square. Four resistive legs branch from the center portion to the input electrode, the output electrode, and the two shunt electrodes.

15 Claims, 20 Drawing Figures

HIGH-PRECISION ELECTRICAL SIGNAL ATTENUATOR STRUCTURES

This invention relates to distributed network resistive film attenuators in general, and specifically to a high-precision attenuator which can be constructed and trimmed to extremely close dB attenuation tolerances using simple techniques.

Attenuators provided with single or multiple distributed regions of thin and thick film resistive material for coaxial lines, waveguides, and the like, are known. There are, for example, the devices described in U.S. Pat. Nos. 3,521,201; 3,157,846; 3,260,971; 4,107,632; 3,227,975; and 2,126,915. Analyses of distributed resistive film attenuator elements exist. A very early mathematical analysis of such elements is contained in Moulton, "Current Flow in Rectangular Conductors," *The Proceeds of The London Mathematical Society,* Section 2, Volume 3, pages 104–110 (January 1905). Later analyses for specific types of distributed film devices are contained in, for example, Smith et al, "Distributed Components in Printed Circuits," *Proceedings of the* 1956 Electronics Components Symposium, pages 212–218; Dow, "The Conjugate Function Approach for Describing Current Density and Resistance in Odd-Shaped Conductors," *Proceedings of the* 1959 Electronic Components Symposium, pages 47–52; Dow, "Synthesis of Multiple Resistance Networks from Single Resistive Films," *IEEE Transactions on Component Parts,* pages 147–155 (December 1963); Hager, "Distributed Parameter Networks for Circuit Miniaturization," *Proceedings of the Electronic Components Conference,* Philadelphia, Pa., May 6–8, 1959, pages 195–203; and Adam, "Precision Thin-Film Coaxial Attenuators," Hewlett-Packard Journal, Vol. 18, No. 10, pages 12–19 (June 1967).

The problems associated with prior art distributed film resistive elements for use in coaxial line attenuators and the like make such distributed film structures unattractive for many applications. Among these problems are that dimensional relationships of film to attenuation in dB are unpredictable, frequently requiring careful hand-trimming under test conditions to achieve a particular dB of attenuation. Additional problems include the problem that, to achieve a particular dB of attenuation, fairly complex distributed film patterns must be generated. Combining the complex pattern requirement with the requirement for careful hand-trimming to achieve a particular dB of attenuation, it will be appreciated that trimming must occasionally be done on fairly complex structures with little margin for error. An additional problem is the seeming unpredictability of the ratio of distributed film dimensions (length, width, shape, and the like) versus amount of attenuation (in dB).

It is an object of the present invention to provide a distributed film attenuator element having distributed film dimensions and configuration which provide highly predictable, highly repeatable, close-tolerance dB of attenuation, without the need for high-precision, complex pattern resistive film deposition. It is a further object of the present invention to provide a distributed film attenuator configuration which permits adjustment to quite precise dB of attenuation. This result is achieved with a distributed resistive film configuration or pattern which behaves in a highly predictable manner with regard to dB of attenuation, rather than the cut-and-try behavior of many prior art distributed resistive attenuator patterns.

Many of the aforementioned references conclude, or at least imply, that attenuation in dB is independent of the sheet resistivity (resistivity per square) of the resistive film used in the generation of the attenuator. Many of such references conclude that attenuation in dB is functionally related only to resistor configuration with respect to the associated ground plane, and the like. It is an object of the present invention to provide an attenuator configuration, the attenuation in dB of which can be predicted with high precision, based upon sheet resistivity (resistance per square) and related considerations.

According to the invention, a signal attenuator comprises a dielectric substrate, an input electrode, an output electrode, and two shunt electrodes. All of the electrodes are provided on the surface of the substrate, with the input and output electrodes being positioned on the substrate for coupling to one conductor of a line carrying the signal, and the two shunt electrodes being positioned on the substrate for coupling to another conductor of the line carrying the signal. The attenuator includes a distributed film resistive element positioned on the substrate surface among the four electrodes, with the distributed resistance film element comprising a center portion, a first leg for coupling the center portion to the first electrode, a second leg for coupling the center portion to the second electrode, a third leg for coupling the center portion to one of the shunt electrodes, and a fourth leg for coupling the center portion to the other shunt electrode.

According to an illustrative embodiment, the signal-carrying line is a coaxial line with a center conductor and a surrounding coaxial conductor. The first and second legs project in opposite directions from the center portion generally along the axis of the center conductor. The third and fourth legs project in opposite directions generally transversely of the center conductor, and provide for attachment to the surrounding coaxial conductor. All of the first, second, third, and fourth legs and the center portion are generally rectangular film patterns.

Additionally according to an illustrative embodiment, the substrate surface is generally rectangular and provides two edges perpendicular to the axis of the coaxial line and two edges parallel to the axis of the coaxial line. The first and second electrodes are provided on respective ones of the first-mentioned two edges, and the two shunt electrodes are provided on respective ones of the second-mentioned two edges.

Further according to an illustrative embodiment, the attenuator includes one or more additional distributed resistive film elements, with such additional distributed resistance film elements each comprising a center portion, a first leg for coupling to the second leg of an adjacent center portion, or to the first electrode, a second leg for coupling to the first leg of an adjacent center portion, or to the second electrode, a third leg for coupling the center portion to one of the shunt electrodes, and a fourth leg for coupling the center portion to the other shunt electrode.

The invention may best be understood by referring to the following description and accompanying drawings which illustrate the invention. In the drawings:

FIG. 1*a* illustrates a resistive film pattern to be generated on one side of a floating microstrip attenuator substrate, or on one side of a microstrip attenuator substrate, or on a stripline attenuator substrate;

FIG. 1*b* is an equivalent schematic circuit diagram for the pattern of FIG. 1*a;*

FIG. 2*a* illustrates a circuit pattern on one side of a floating microstrip substrate, or on one side of a microstrip substrate, or on a stripline attenuator substrate;

FIG. 2*b* is an equivalent schematic circuit diagram for the pattern of FIG. 2*a;*

FIG. 3*a* is a view of a circuit pattern on one side of a floating microstrip attenuator, microstrip attenuator, or stripline attenuator substrate, which is a composite of the components illustrated in FIGS. 1*a* and 2*a;*

FIG. 3*b* is an equivalent schematic circuit diagram of the pattern of FIG. 3*a;*

FIG. 4*a* is a view of one side of a floating microstrip attenuator, microstrip attenuator, or a stripline attenuator substrate;

FIG. 4*b* is an equivalent schematic circuit diagram of the film of FIG. 4*a;*

FIG. 5*a* is a view of a circuit pattern on one side of another illustrative microstrip, floating microstrip, or stripline attenuator substrate;

FIG. 5*b* is an equivalent schematic circuit diagram of the film of FIG. 5*a;*

FIG. 6 is a perspective view of a microstrip attenuator constructed according to the invention for insertion into a coaxial line or the like;

FIG. 7 is a perspective view of a floating microstrip attenuator constructed according to the invention for insertion into a coaxial line or the like;

FIGS. 8 and 9 are perspective views of coaxial line attenuators on hemicylindrical substrates for insertion into circular cross-section coaxial lines or the like;

Figure 10A:
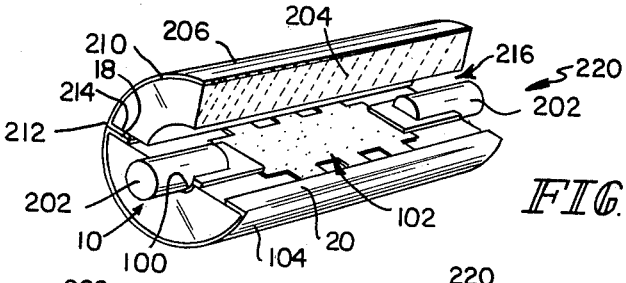
Figure 10B:
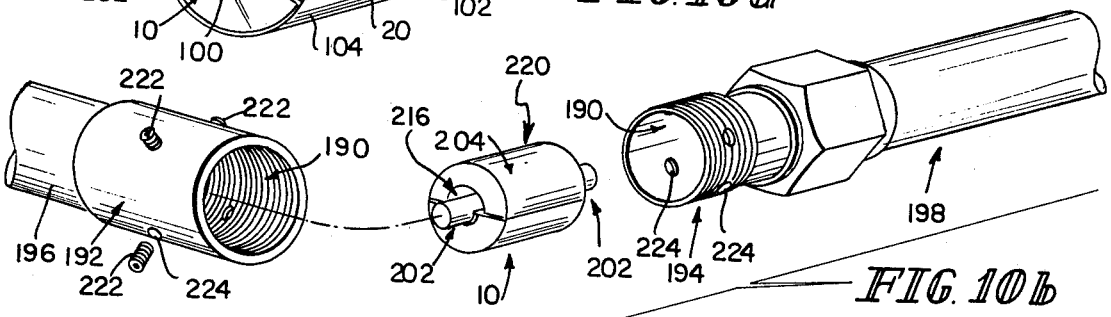

FIG. 10*a* is a partly fragmentary perspective view of a completed circular cross-section coaxial stripline attenuator constructed according to the present invention;

FIG. 10*b* is an exploded view of a typical mounting for the attenuator of FIG. 10*a;*

Figure 11:
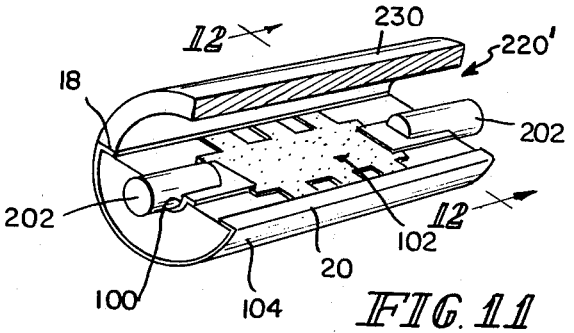
Figure 12:
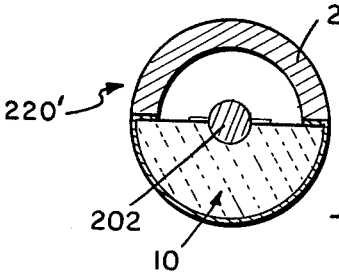
Figure 13:
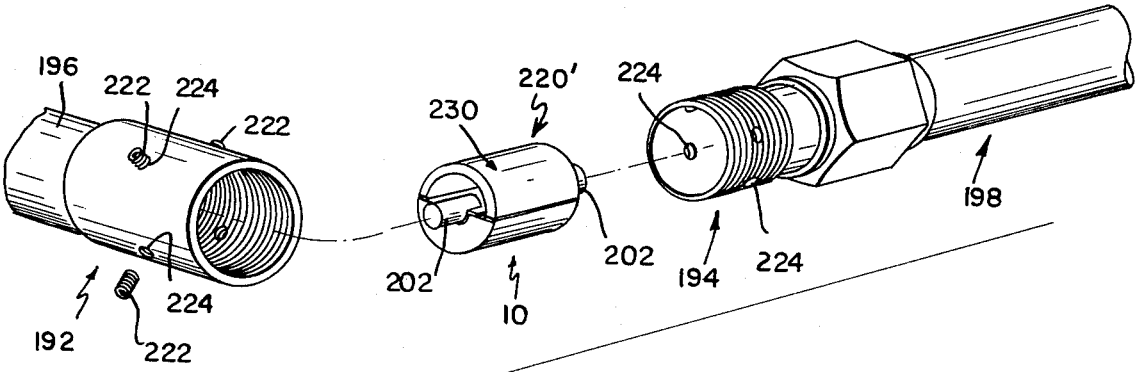
Figure 14:
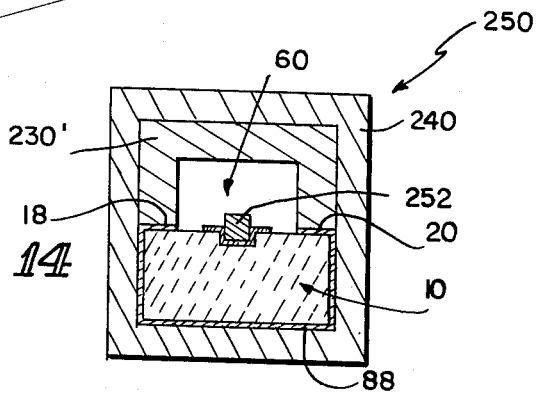

FIG. 11 is a partly fragmentary perspective view of a completed circular cross-section coaxial microstrip; attenuator constructed according to the present invention;

FIG. 12 is a sectional view of the attenuator of FIG. 11 taken generally along section lines 12—12 thereof;

FIG. 13 is an exploded view of a typical mounting for the attenuator of FIGS. 11–12; and FIG. 14 is a generally transverse sectional view through a completed rectangular cross-section microstrip attenuator for insertion into a rectangular receptacle in a waveguide or the like.

Figure 1A:
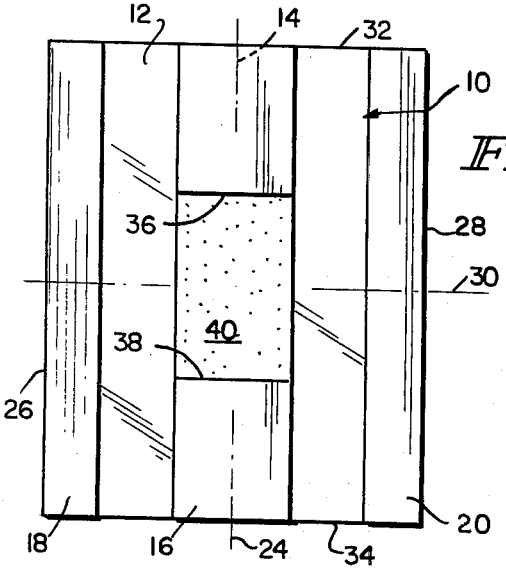

FIG. 1*a* shows a dielectric substrate 10, upon one surface 12 of which are provided a first series electrode 14, a second series electrode 16, a first shunt electrode 18, and a second shunt electrode 20. The series electrodes 14, 16 lie generally along the center line 24 between the longitudinal edges 26, 28 of surface 12. The first shunt electrode 18 is provided along the longitudinal edge 26. The second shunt electrode 20 is provided along the longitudinal edge 28. Electrodes 14, 16, 18, 20 illustratively are formed from silver or a silver alloy, or some other highly conductive metal. Typically, the electrodes 14, 16, 18, 20 are generated on surface 12 by evaporation or a similar deposition technique.

Each of electrodes 14, 16 extends toward a center line 30 between their respective transverse edges 32, 34 of surface 12. The ends 36, 38, respectively, of electrodes 14, 16 remote from their respective transverse edges 32, 34 are substantially equidistantly spaced from the center line 30. A resistive film 40 is provided in the space between the ends 36, 38 of electrodes 14, 16, respectively. The electrodes 14, 16 provide connections between the resistive film 40 and external circuit components, such as the center conductor of a coaxial line (not shown). Typically, the resistive film 40 can be deposited by means of sputtering, in the case in which the resistive film 40 is composed of a refractory metal base, or painting or other deposition technique where the resistive film 40 is formed from, for example, a carbon-containing composition which is subsequently baked or otherwise cured on the substrate surface 12.

For purposes of illustration, the shunt electrodes 18, 20 can be thought of as contacting the coaxial outer conductor of a coaxial line (not shown). Thus, in this description, electrodes 18, 20 can hereafter be thought of as being at ground potential. Thus, the schematic circuit diagram of FIG. 1*b* forms the equivalent circuit representation of the circuit formed on surface 12. The resistors 42, 44 indicated as being between electrodes 14, 16 comprise the series resistance of the film 40 between the ends 36, 38 of terminals 14, 16. Resistors 42, 44 can be thought of as equal in resistance value, since the resistive film has arbitrarily been divided into a portion extending between the end 36 of terminal 14 and center line 30, and a portion extending between center line 30 and the end 38 of terminal 16. This will, of course, be the case if the resistive film 40 is of uniform thickness and composition. The values of the resistors 42, 44 can be readily calculated if the resistance per square of film 40 is known, and the dimensions of film 40 are known. Namely, each resistor 42, 44 will have a value equal to the resistance per square times the distance between ends 36, 38 measured along center line 24, divided by the width of the resistive film 40 measured along center line 30, times one-half.

Typically, where the resistive film 40 is formed from a refractory metal, a protective oxide coating will be formed on top of the refractory metal film, as by anodization, to protect and stabilize the resistance per square of the film 40, as well as to trim or adjust the resistance per square of the film 40 to the desired value to obtain desired values for the resistors 42, 44.

Figure 1B:
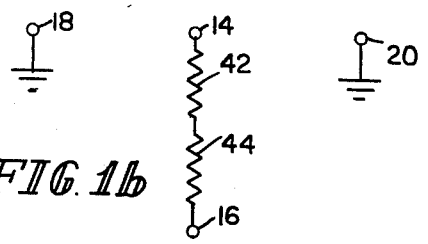

In the following descriptive materials, those elements numbered identically with the elements of FIGS. 1*a*–1*b* perform the same or similar functions.

Figure 2A:
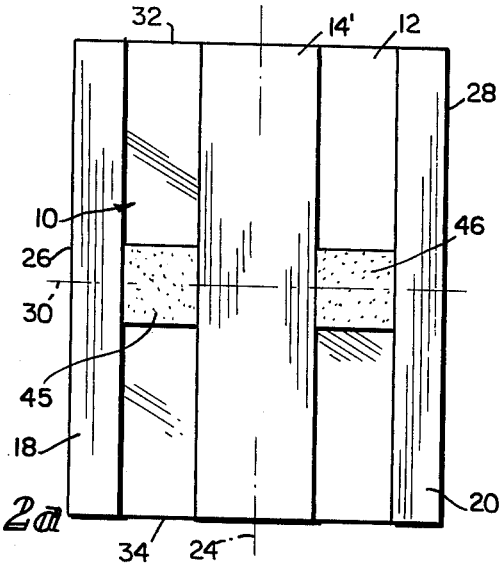
Figure 2B:
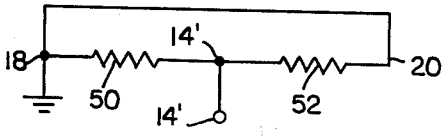

In FIGS. 2*a*–2*b*, two more views presented for purposes of illustration of the invention, the dielectric substrate 10 is provided with the shunt electrodes 18, 20. However, in the embodiment illustrated in FIGS. 2*a*–2*b*, a single strip electrode 14' extends the full distance across surface 12 between its transverse edges 32, 34. In this embodiment, two equal-configuration resistive film areas 45, 46 extend in opposite directions from the center electrode 14' to respective shunt electrodes 18, 20. In this embodiment, as best illustrated in FIG. 2*b*, the films 45, 46 provide two equivalent resistors 50, 52 extending between the center electrode 14' and respective shunt electrodes 18, 20. Again, the resistance values of resistors 50, 52 can both be calculated by multiplying the resistance per square of the resistive films 45, 46 by the lengths of these resistive films 45, 46 between adjacent contact edges of the electrode 14' and their respective shunt electrodes 18, 20, and dividing by the widths of the resistive film areas 45, 46 measured parallel to center line 24. Again, in FIG. 2*b*, it is assumed that the shunt electrodes 18, 20 are coupled to ground.

Figure 3A:
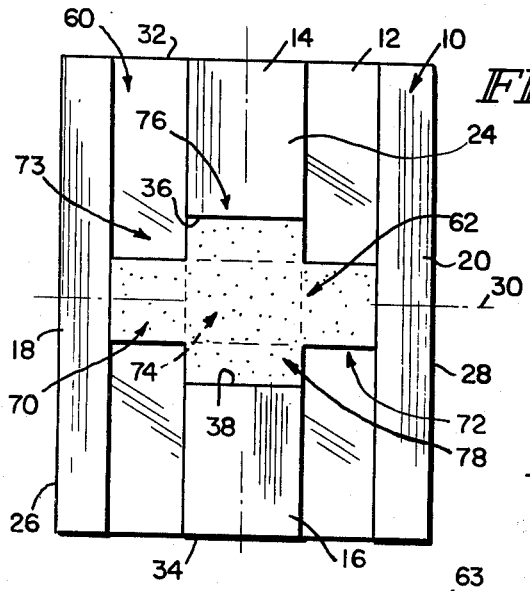
Figure 3B:
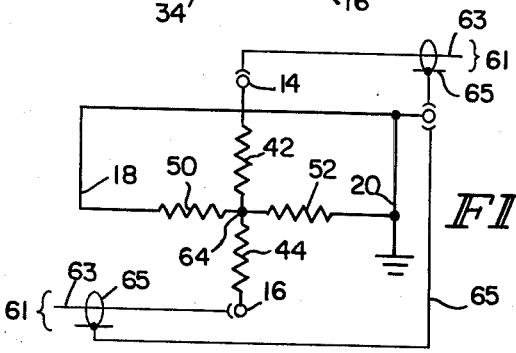

The teachings incorporated in FIGS. 1a–1b and 2a–2b can be combined as illustrated in FIGS. 3a–3b to provide a combination series-shunt resistance attenuator 60. The attenuator 60 may be of a floating microstrip type for insertion between two opposed wall surfaces of a waveguide or the like, with the illustrated attenuator pattern being provided on surface 12 of substrate 10 and a ground plane conductor pattern (not shown) being provided on the reverse surface of the substrate 10 from surface 12. Alternatively, the attenuator illustrated in FIG. 3a can be a microstrip attenuator with a conductive film completely covering the reverse side from the side illustrated and joining the shunt electrodes 18, 20. As another alternative, the attenuator illustrated in FIG. 3a could be a stripline-type attenuator, with another layer of dielectric material, e.g., ceramic, being required to be attached to the surface 12 to insulate it from its surrounding to complete the stripline attenuator. The same design considerations could be applied equally to the formation of an attenuator for use in a coplanar waveguide, a slot line, a suspended substrate, or coupled coaxial lines.

The resistance of the combined resistive film 62 illustrated in FIG. 3a is shown in the equivalent schematic circuit diagram of FIG. 3b. The circuit of FIG. 3b is illustrated as being inserted into a coaxial line 61, terminals 14, 16 being coupled in series with the center conductor 63 of the line, and the grounded outer coaxial conductor 65 of the line 61 being coupled to terminals 18, 20. It will be immediately appreciated that the resistive network of the attenuator of FIG. 3a is equivalent to two resistors of value equal to the values of resistors 42, 44 from FIG. 1a–1b in series between terminals 14, 16 and two shunt resistors having resistance values equal to resistors 50, 52 from FIGS. 2a–2b. Thus, the resistance between terminals 14, 16 includes two series resistors 42, 44 with a shunt resistor coupling their common terminal 64 to ground, the shunt resistor having a value equal to one-half the resistance values of resistors 50, 52.

For a particular amount of attenuation in dB, the values of resistors 42, 44 and 50, 52 are known from the following Table I.

| ATTENUATION (dB) | SERIES ARM R (Resistance of Resistors 42, 44 in) | SHUNT R (Shunt Resistance 50, 52 in) |
|---|---|---|
| .1 | .289 | 4,343 |
| .2 | .576 | 2,171 |
| .3 | .863 | 1,447 |
| .4 | 1.151 | 1,085 |
| .5 | 1.439 | 868 |
| .6 | 1.726 | 723 |
| .7 | 2.014 | 620 |
| .8 | 2.301 | 542 |
| .9 | 2.588 | 482 |
| 1 | 2.875 | 433.3 |
| 2 | 5.731 | 215.2 |
| 3 | 8.550 | 141.9 |
| 4 | 11.31 | 104.8 |
| 5 | 14.01 | 82.24 |
| 6 | 16.61 | 66.93 |
| 7 | 19.12 | 55.80 |
| 8 | 21.53 | 47.31 |
| 9 | 23.81 | 40.59 |
| 10 | 25.97 | 35.14 |

Since certain of the dimensions of the pattern generated on surface 12 will be dictated by the particular application for the attenuator 60, the remaining dimensions for the resistive film 62 can be calculated in such an application. For example, for a coaxial line-suspended substrate in a coaxial line having SMA line size, the width of the electrodes 14, 16, measured parallel to center line 30, will be about 0.090" (about 2.286 millimeter). In this type line, the distance between the longitudinal edge of each of electrodes 14, 16 (parallel to center line 24) and the adjacent longitudinal edge of a respective shunt electrode 18, 20 will be approximately 0.030" (about 0.762 millimeter). Using the equations set forth above, and assuming a 90 per square sheet resistance, it will be apparent that the length of the resistive film 62 between ends 36, 38 of electrodes 14, 16, respectively, will behave according to the following Table II.

| ATTENUATION (in dB) | LENGTH BETWEEN ELECTRODE EDGES 36, 38 (in inches) | LENGTH BETWEEN ELECTRODE EDGES 36, 38 (in millimeters) |
|---|---|---|
| .1 | .000578 | .01468 |
| .2 | .00115 | .02921 |
| .3 | .001736 | .04409 |
| .4 | .00230 | .05842 |
| .5 | .002878 | .073101 |
| .6 | .00345 | .08763 |
| .7 | .004028 | .10231 |
| .8 | .004602 | .116891 |
| .9 | .005176 | .13147 |
| 1 | .00575 | .14605 |
| 2 | .011462 | .29113 |
| 3 | .0171 | .43434 |
| 4 | .02262 | .57455 |
| 5 | .02802 | .71171 |
| 6 | .03322 | .84379 |
| 7 | .03824 | .97129 |
| 8 | .04306 | 1.09372 |
| 9 | .04762 | 1.20955 |
| 10 | .05194 | 1.31928 |

Also using the equations set forth above, it will be appreciated that the dimensions of the shunt legs 70, 72 of the resistive film 62 measured parallel to center line 24 will be as illustrated in the following Table III.

| ATTENUATION (in dB) | WIDTH OF SHUNT RESISTANCE FILM PATHS (in inches) | WIDTH OF SHUNT RESISTANCE FILM PATHS (in millimeters) |
|---|---|---|
| .1 | .00311 | .007899 |
| .2 | .000622 | .015799 |
| .3 | .000932 | .023673 |
| .4 | .001244 | .031598 |
| .5 | .001555 | .039497 |
| .6 | .001867 | .04742 |
| .7 | .002177 | .055295 |
| .8 | .002491 | .0632714 |
| .9 | .00280 | .07112 |
| 1 | .003115 | .079121 |
| 2 | .006279 | .159487 |
| 3 | .0095 | .24165 |
| 4 | .0129 | .32719 |
| 5 | .0146 | .37175 |
| 6 | .0202 | .51233 |
| 7 | .0242 | .61452 |
| 8 | .0285 | .72479 |
| 9 | .0333 | .84479 |
| 10 | .0384 | .97536 |

It will be appreciated that the basic building block resistive element 73, as illustrated in FIG. 3a, comprises a rectangular central portion 74 (illustrated within the broken lines in FIG. 3a), a first leg 76 extending from the central portion 74 to make contact at edge 36 with electrode 14, a second leg 78 projecting from the central portion 74 to make contact at edge 38 with second electrode 16, the third leg 70 projecting from central portion 74 to make contact with the first shunt electrode 18, and the fourth leg 72 which projects from the central portion 74 to make contact with the second shunt electrode 20.

Figure 4A:
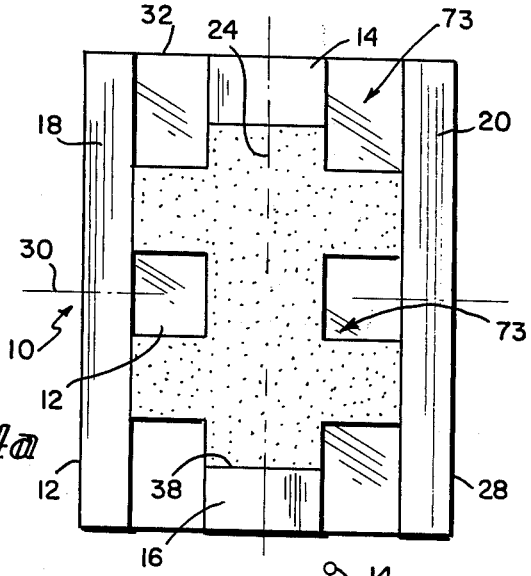
Figure 4B:
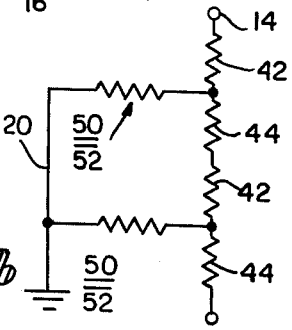

It will further be appreciated, with reference to FIGS. 4a–4b and 5a–5b, that these basic building blocks 73 of resistive film can be generated and combined in various combinations in 0.1 dB increments, 1 dB increments, 10 dB increments, etc., to achieve various amounts of attenuation between terminals 14, 16. For example, two 1 dB attenuators can be combined as illustrated in FIGS. 4a–4b to achieve two dB of attenuation between terminals 14, 16 of FIG. 4a.

Figure 5A:
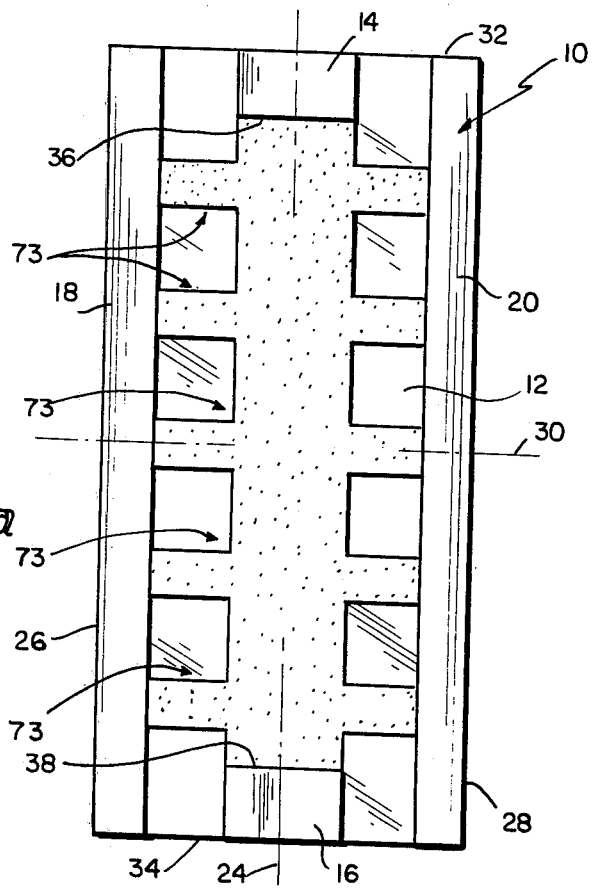
Figure 5B:
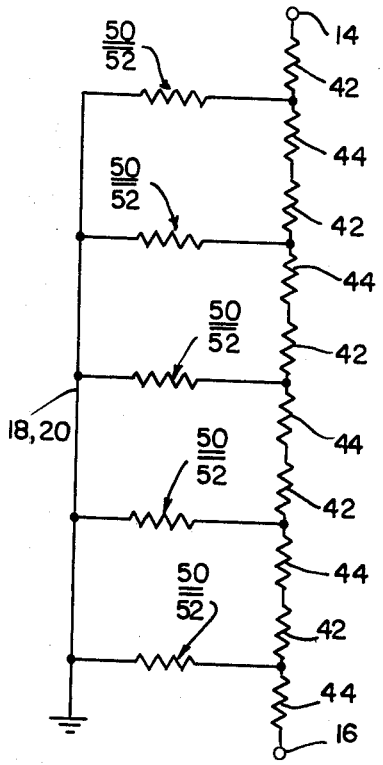

As illustrated in FIGS. 5a–5b, five 10 dB blocks 73 can be combined to achieve a 50 dB attenuation between terminals 14, 16 of those figures.

Further, 0.1 dB blocks, 1 dB blocks, and 10 dB blocks can be combined in the manner taught herein to achieve, for example, a 77.2 dB attenuator, and so on.

As illustrated in FIGS. 6–9, the basic attenuator building blocks can be generated on substrates with various types of terminations for various types of applications. Typical terminations include the so-called "N" type connector and 7 mm. connector.

Figure 6:
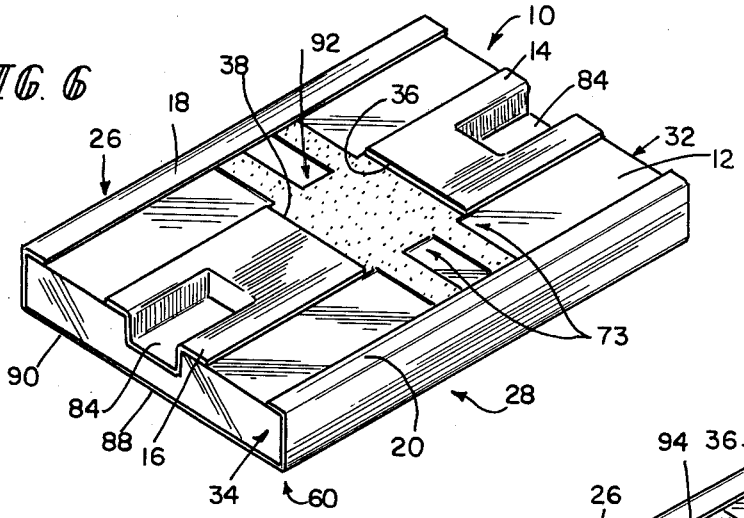

In the embodiment of FIG. 6, recesses 84 are provided adjacent the edges 32, 34 of substrate 10 for connector terminations. These recesses 84 typically are plated or otherwise coated with the same conductive material from which the electrodes 14, 16 are formed. In the embodiment illustrated in FIG. 6, the shunt conductors 18, 20 are joined by a conductor ground plane 88 plated or otherwise formed on the reverse surface 90 from surface 12. This is the configuration of a microstrip attenuator. It will be noted that the attenuator resistive film 92 is constructed from two identically shaped basic building blocks 73. Thus, the film 92 attenuation is twice the attenuation of a single one of the blocks 73, whether that attenuation be 0.1 dB, 8 dB, 2500 dB, etc.

Figure 7:
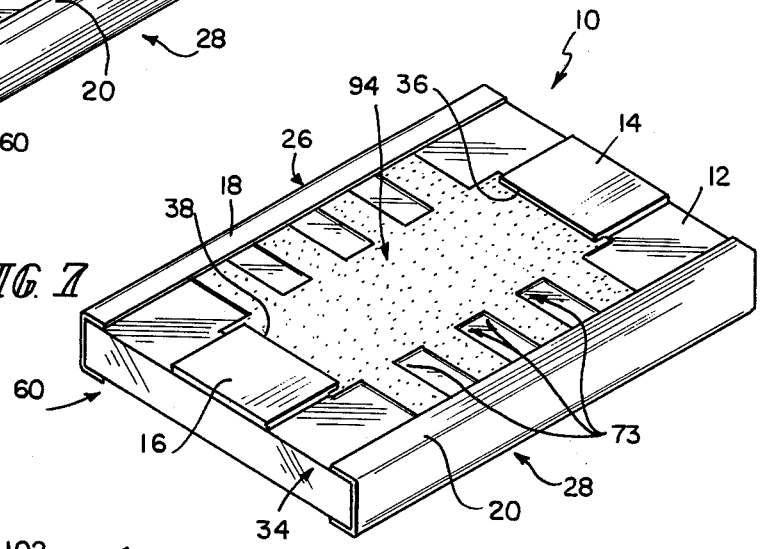

Turning to FIG. 7, the attenuator 60 of the embodiment there illustrated includes an attenuator film 94 comprised of four identical basic building blocks 73. Thus, the attenuation between terminals 14, 16 of the embodiment of FIG. 7 is four times the attenuation provided by one of such building blocks 73. It should be understood that the four building blocks 73 of the attenuator film 94 illustrated in FIG. 7 need not necessarily all provide the same attenuation. In other words, a 6 dB building block can be placed in series with a 30 dB building block, a 2 dB building block and a 1 dB building block to achieve 39 dB of attenuation between terminals 14, 16. The attenuator building blocks can be combined in any desired configuration to achieve a desired degree of attenuation. It should be further noted from FIG. 7 that the shunt conductors 18, 20 "wrap" around the edges 26, 28 of the substrate 10 in the manner of a floating microstrip ground connection.

Figure 8:
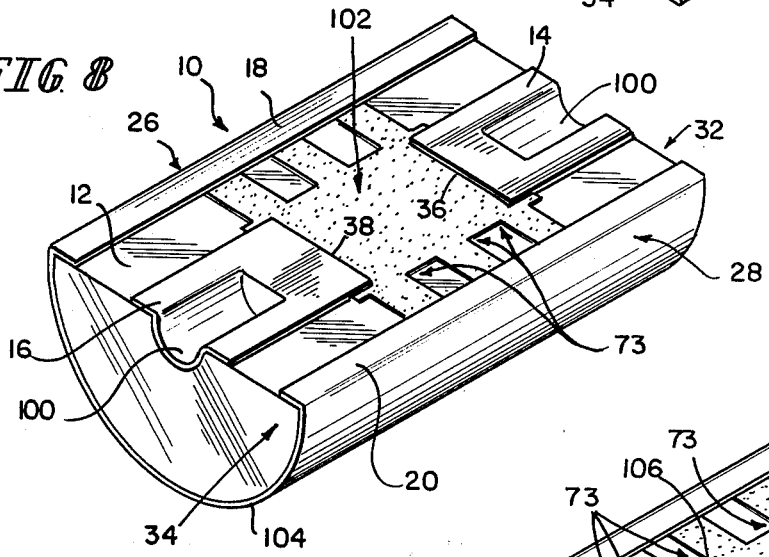

In the embodiment of the invention illustrated in FIG. 8, the attenuator pattern is generated on a hemicylindrical substrate having hemicylindrical recesses 100 forming portions of its electrodes 14, 16. Again, the recess 100 surfaces are plated or otherwise coated with the same type of conductive material from which the surrounding conductor 14, 16 regions are formed. The attenuator film 102 of this embodiment comprises three building blocks 73. Illustratively, the building blocks are of equal configurations and thus provide equal dB of attenuation, assuming their film thicknesses (and therefore sheet resistances) are equal. If each building blocks provides 0.33 dB of attenuation, the attenuation between terminals 14, 16 is approximately 1 dB.

As best illustrated in FIGS. 10a–10b, the hemicylindrical substrate 10 of this embodiment is suitably shaped for insertion into a right circular cylindrical coaxial line, or into a cavity 190 provided between the couplers 192, 194 at the junction of two such lines 196, 198, respectively. The recesses 100 accommodate and provide connection terminations 202 for the center conductors (not shown) of such lines. The shunt conductors 18, 20 are joined by a curved conductive ground plane 104. In the embodiment of FIGS. 10a–10b, another hemicylindrical substrate 204 is provided to cover the film 102 and form a cylindrical structure which fills the cavity 190. Substrate 204 has a metallized or otherwise conductive ground plane film 206 provided on its curved surface 210. The ground plane film 206 wraps around the longitudinal edges 212 of the substrate 204, so that when substrate 204 is in position on substrate 10, the ground conductive electrodes 18, 20 are in conductive contact with ground conductive strips 214 formed at the edges 212. Cavities 216 are formed in substrate 204 to accommodate the terminations 202.

To install the assembly 220 consisting of substrates 10, 204 and associated terminations 202, assembly 220 is loaded into the male connector 194 portion of the cavity 190 such that contact is made between the center conductor of line 198 and a respective one of terminations 202. The male and female connectors 192, 194, are then joined. Cavity 190 is sized such that by joining the connectors 192, 194, the other termination 202 is forced into conductive contact with the center conductor of line 196. After connectors 192, 194 are completely joined, small screws 222 are inserted through mating holes 224 in connectors 192, 194 to maintain connectors 192, 194 in engagement with one another and terminations 202 in engagement with the center conductors of lines 196, 198. Screws 222 also maintain good electrical contact between the ground plane conductors 104, 206 and the walls of the cavity 190.

In the embodiment illustrated in FIGS. 11–12, the substrate 204 is replaced by a hemicylindrical metal shell 230 which serves the same purposes as substrate 204. The shell 230 rests upon, and establishes electrical contact with, ground plane electrodes 18, 20. As best illustrated in FIG. 13, the mounting technique for the assembly 220' of FIGS. 11–12 is the same as that for the assembly 220 of FIGS. 10a–b.

As best illustrated in FIG. 14, the technique of FIGS. 11–13 can be employed in rectangular cross-section waveguides 240 and the like with substrates 10 such as those illustrated in FIG. 6. In such applications, a rectangular metal shell 230' is placed in conductive contact on the ground plane electrodes 18, 20 which are joined by a ground plane metallization 88. The assembly 250 is loaded into the waveguide 240 with metallization 88 and shell 230' in contact with the waveguide inner side walls. If necessary, screws such as screws 222 of FIGS. 10b, 13 can be used to secure the assembly 250 within the waveguide 240. Appropriate terminations 252 are made between the attenuator 60 and other circuit components within the waveguide 240.

Figure 9:
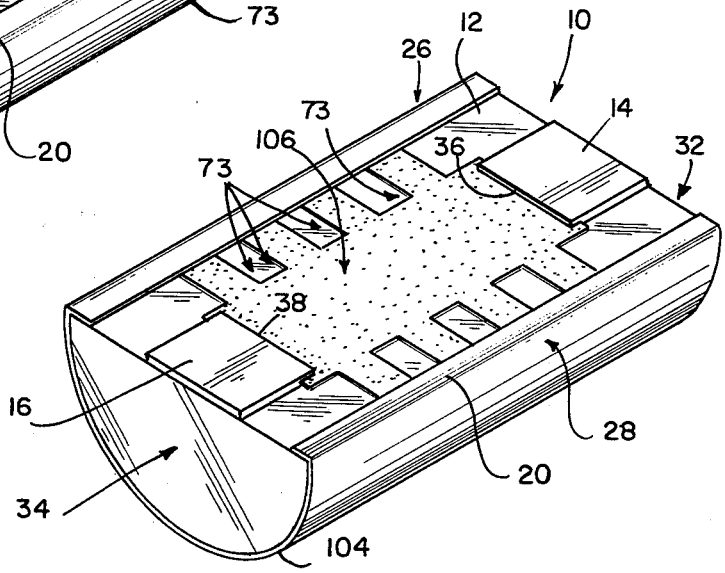

In the embodiment illustrated in FIG. 9, a hemicylindrical substrate 10 is again used. The same ground plane 104 configuration is used as in FIG. 8. The electrodes 14, 16 are flat. Four of the resistive film building blocks 73 provide the attenuator film 106 of FIG. 9. Again, the building blocks are illustrated as being of identical configuration. Thus, if a single building block were constructed to provide a nominal 10 dB of attenuation, a total of 40 dB of attenuation would exist between electrodes 14, 16. Again, however, it should be understood that the four building blocks forming attenuator film 106 need not be identical in configuration, and may thus provide different dB of attenuation. To determine the total dB of attenuation between electrodes 14, 16, the dB of attenuation of each of the building blocks need only be added together. If, for example, the attenuations provided by the building blocks 73 forming film 106 were 10 dB, 6 dB, 18 dB, and 8 dB, the total attenuation between electrodes 14, 16 in FIG. 9 would be 42 dB.

What is claimed is:

1. An electrical signal attenuator for insertion into a line, comprising:

a dielectric substrate;

an input electrode, an output electrode, and two shunt electrodes, all provided on a surface of the substrate, the input and output electrodes being positioned on the substrate for coupling to a conductor of the line and the two shunt electrodes being positioned on the substrate for coupling to another conductor of the line;

a distributed resistance film element positioned on the substrate surface among the four electrodes, the distributed resistance film element comprising a center portion, a first leg for coupling the center portion to the first electrode, a second leg for coupling the center portion to the second electrode, a third leg for coupling the center portion to one of the shunt electrodes, and a fourth leg for coupling the center portion to the other shunt electrode.

2. The attenuator of claim 1 wherein the first and second legs project in opposite directions from the center portion generally longitudinally of the line.

3. The attenuator of claim 2 wherein the third and fourth legs project in opposite directions generally transversely of the line.

4. The attenuator of claim 3 wherein all of the first, second, third, and fourth legs and the center portion are generally rectangular.

5. The attenuator of claim 1 wherein the substrate surface is generally rectangular to provide two edges which extend generally perpendicular to the axis of the line and two edges which extend generally parallel to the axis of the line, the first and second electrodes being provided on respective ones of the first-mentioned two edges and the two shunt electrodes being provided on respective ones of the second-mentioned two edges.

6. The attenuator of claim 1 and further comprising a second distributed resistance film element, the second distributed resistance film element comprising a second center portion, a fifth leg for coupling the second center portion to the second leg, a sixth leg for coupling the second center portion to the second electrode, a seventh leg for coupling the second center portion to one of the shunt electrodes, and an eighth leg for coupling the second center portion to the other shunt electrode.

7. The attenuator of claim 6 wherein the fifth and sixth legs extend colinearly with the first and second legs.

8. In an electrical signal attenuator, a distributed resistance film element positioned on a substrate surface among four electrodes in two pairs, with one pair being opposed series electrodes and the other pair being opposed shunt electrodes, said element comprising a center portion, a first leg for coupling the center portion to a first series electrode, a second leg for coupling the center portion to a second series electrode, a third leg for coupling the center portion to a first shunt electrode, and a fourth leg for coupling the center portion to a second shunt electrode.

9. The element of claim 8 wherein the first and second series legs project in opposite directions from the center portion generally along the same line.

10. The element of claim 9 wherein the first and second shunt legs project in opposite directions generally transversely of the line.

11. The element of claim 10 wherein all of the first, second, third, and fourth legs and the center portion are generally rectangular.

12. The attenuator of claim 8 and further including a second distributed resistance film element, the second element comprising a second center portion, a third series leg for coupling the second center portion to the second series leg, a fourth series leg for coupling the second center portion to the second electrode, a third shunt leg for coupling the second center portion to one of the shunt electrodes, and a fourth shunt leg for coupling the second center portion to the other shunt electrode.

13. The pattern of claim 12 wherein the third and fourth series legs extend colinearly with the first and second series legs.

14. The pattern of claim 13 wherein the third and fourth shunt legs project parallel with the first and second shunt legs.

15. The attenuator of claim 8 or 12 in which the resistive element pattern is repeated.

* * * * *